US006845904B1

(12) United States Patent
South

(10) Patent No.: US 6,845,904 B1
(45) Date of Patent: Jan. 25, 2005

(54) MAILBOX WITH TRANSPARENT PANEL

(76) Inventor: Paul J. South, 3018 Grace St., Greenwood, IN (US) 46143

( * ) Notice: Subject to any disclaimer, the term of this patent is extended or adjusted under 35 U.S.C. 154(b) by 0 days.

(21) Appl. No.: 10/180,656

(22) Filed: Jun. 26, 2002

(51) Int. Cl.[7] ..... B65D 91/00
(52) U.S. Cl. ..... 232/38
(58) Field of Search ..... D99/29–32; 232/38, 232/17

(56) References Cited

U.S. PATENT DOCUMENTS

| | | | | | |
|---|---|---|---|---|---|
| 1,393,944 | A | | 10/1921 | Chapman | |
| 1,483,077 | A | | 2/1924 | Cole | |
| 1,542,217 | A | | 6/1925 | Cole | |
| 1,959,963 | A | | 5/1934 | Overmyer | |
| 2,370,682 | A | | 3/1945 | Overmyer | |
| 2,452,667 | A | * | 11/1948 | Lambert | 40/566 |
| 2,552,628 | A | * | 5/1951 | Gallaher | 232/17 |
| 2,561,007 | A | | 7/1951 | Bierig | |
| D167,928 | S | * | 10/1952 | Coward Jr. | |
| 3,107,848 | A | | 10/1963 | Penta | |
| D254,455 | S | | 3/1980 | Cornwell, Jr. et al. | |
| 4,244,512 | A | | 1/1981 | Wise | |
| 4,650,113 | A | | 3/1987 | Hunt | |
| 4,905,891 | A | * | 3/1990 | Wildish et al. | 232/17 |
| D315,821 | S | | 3/1991 | Lorenzi | |
| 5,056,711 | A | * | 10/1991 | Bush | 232/17 |
| D330,793 | S | | 11/1992 | Hampton | |
| D332,166 | S | | 12/1992 | Williams | |
| D335,903 | S | | 5/1993 | Swindle | |
| D337,417 | S | | 7/1993 | McNiven | |
| D354,611 | S | * | 1/1995 | Hazlett | D99/30 |
| 2002/0121543 | A1 | * | 9/2002 | Simmons | 232/17 |
| 2003/0205614 | A1 | * | 11/2003 | Klima et al. | 232/38 |
| 2003/0213837 | A1 | * | 11/2003 | Morgan | 232/38 |

* cited by examiner

*Primary Examiner*—William L. Miller
(74) *Attorney, Agent, or Firm*—Woodard, Emhardt, Moriarty, McNett & Henry LLP

(57) ABSTRACT

A mailbox which incorporates at least one transparent panel so as to enable a mail carrier or owner to view the contents prior to opening the mailbox includes a main body which is shaped with opposite sides and a curved top portion. The construction of the mailbox also includes a base panel, a front door which is hinged to the base panel, and a rear panel which completes the closure of the mailbox. The rear panel may be configured as a second door, in which case it is hinged to the base panel. Assembled within the main body of the mailbox is a transparent panel which in one embodiment is positioned in the curved top portion of the main body. In alternate embodiments, a transparent panel is assembled into the front door of the mailbox and in yet a further variation, a transparent panel is assembled into the rear panel. A variety of embodiments is disclosed involving a plurality of transparent panels which are arranged in different locations and in different patterns across the main body of the mailbox.

2 Claims, 12 Drawing Sheets

MAILBOX WITH TRANSPARENT PANEL

BACKGROUND OF THE INVENTION

The present invention relates in general to structural and ornamental mailbox designs, and importantly a combination of both, which provide user enhancements and improved security to those depositing mail in and/or removing mail from the mailbox. More specifically, the present invention discloses the addition of one or more transparent panels to the body and/or the door (lid), either front or back, or both, of the mailbox. The disclosed transparent panels may take on a variety of shapes and sizes and may be positioned in a variety of locations on the mailbox and in a variety of patterns or arrangements. In one alternative embodiment of the present invention, one or more of the panels are changed from transparent to translucent.

There are several reasons why it is desirable to be able to see what might be in a mailbox before opening the door (lid). The owner may prefer to see if there is any mail in the mailbox at a glance, rather than going through the effort of opening and then closing the door to the mailbox, only to learn that there is no mail or that the mail has not yet been delivered. The mail carrier may wish to see that the mailbox is empty before opening the door to deposit that day's mail. If a delivery is being made and the delivery person can see that the recipient has not yet picked up that day's mail, then it might be acceptable to place the delivery item in the mailbox, knowing that it will be received by the recipient when the mail is picked up. If the mailbox is empty, then there is the possibility that the mail for that day has already been picked up and the delivery should be made directly to the residence or business, if the scheduled recipient is going to actually receive the delivery that day.

One concern in providing a transparent or translucent panel as part of a mailbox is whether there is a loss of privacy. While anyone can obviously open another's unlocked mailbox to see what is inside, the issue relates more to casual passersby. In the case of rural mailboxes where the mailbox may be several yards from the residence and where there may be numerous vehicles driving by, it may be preferable to not reveal what is in the mailbox to such passersby. Such individuals would not likely simply drive by and open each mailbox. However, if they happen to see that mail had been delivered or that a particular item or article was in the mailbox, there could be a temptation to examine the mailbox contents and possibly remove items. For example, if a passerby happened to notice that a particular magazine had been delivered, there could be a temptation to remove that magazine from the mailbox. Without a transparent panel, the likelihood of that pilferage is believed to be fairly low.

As the transparent (or translucent) panel is made smaller and thus less "open" to passersby, the amount of light which can enter the mailbox to help illuminate the contents becomes more limited. If the panel was relatively small considering the size of the mailbox, or if a translucent panel is used which will not transmit as much light, it may not be possible to see at least a portion of each article which may be in the mailbox. This could be a combination of the panel not being large enough to see into the "corners" of the mailbox and not letting in sufficient light to illuminate any items located in the corners of the mailbox.

One advantage of the present invention is to enable the mail carrier to see that no explosive device or hazardous material has been positioned in the mailbox prior to opening the front door of the mailbox for depositing the mail. While this is not necessarily the primary purpose of the present invention, it is an important aspect and a benefit of the present invention. Depending on the degree of pranks, vandalism, and terrorism which might be occurring in a particular region or neighborhood, this aspect of the present invention may have an enhanced value.

SUMMARY OF THE INVENTION

A mailbox having a transparent panel for revealing the contents of the mailbox according to one embodiment of the present invention includes a main body shaped with opposite sides and a curved top portion and including a base panel. A front door is hinged to the main body and a rear panel is included which may be in the form of a rear door and thus openable in the same manner as the front door. Included as part of the disclosed mailbox is a transparent panel which is assembled into the curved top portion of the main body at a location between the front door and the rear panel.

One object of the present invention is to provide an improved mailbox.

Related objects and advantages of the present invention will be apparent from the following description.

DESCRIPTION OF THE PREFERRED EMBODIMENT

Figure 1:
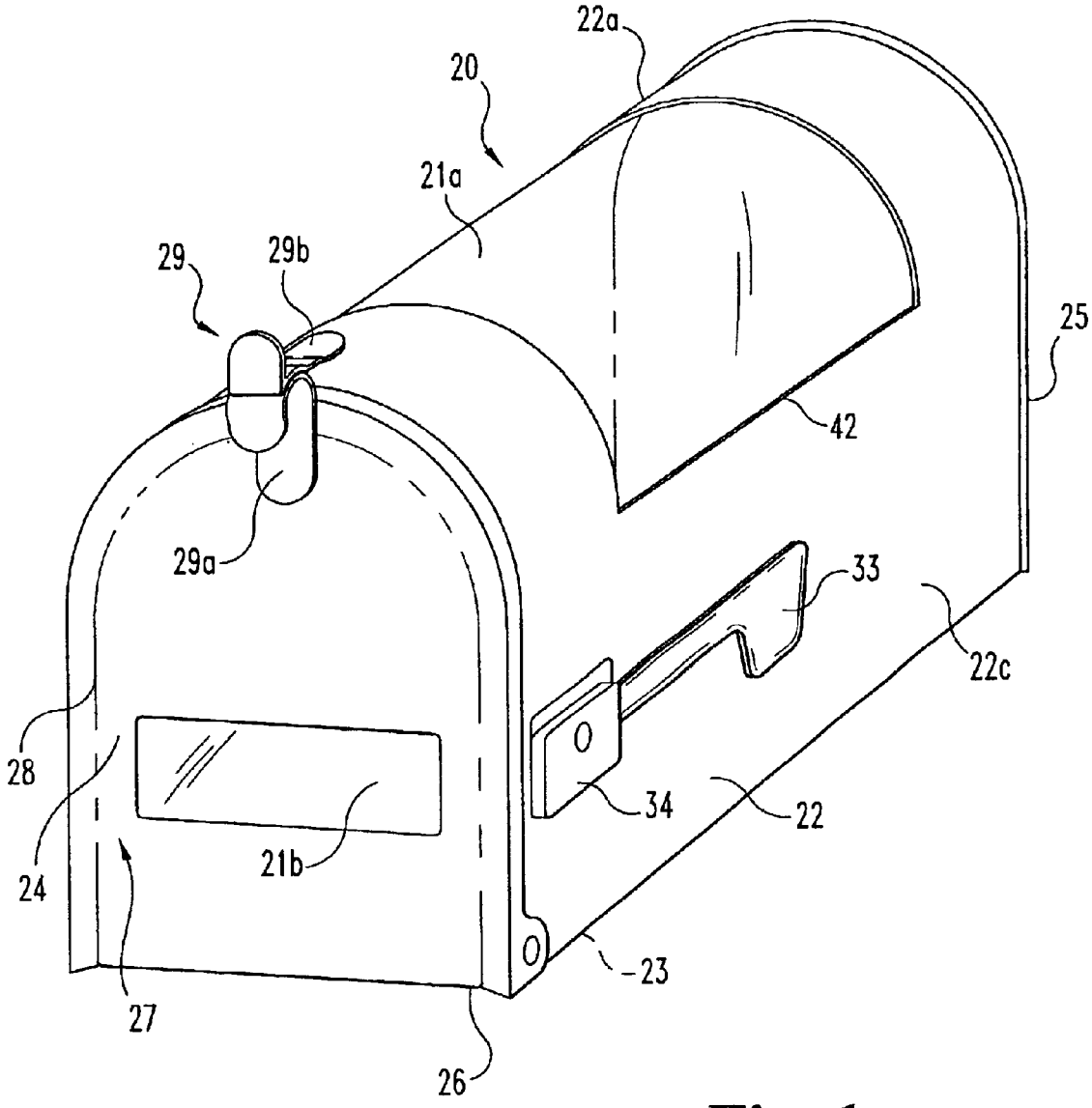
FIG. 1 is a perspective view of a mailbox with a transparent panel according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
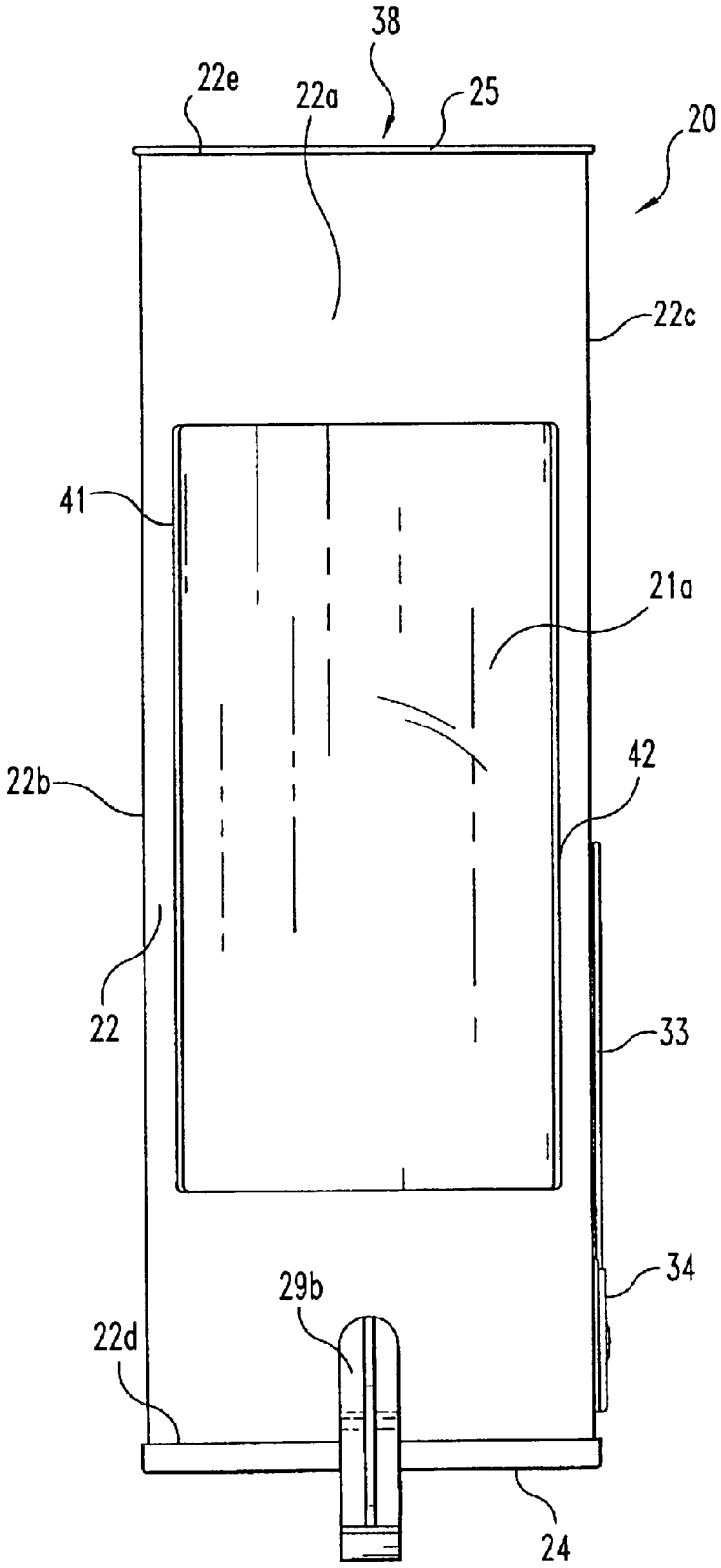
FIG. 2 is a top plan view of the FIG. 1 mailbox.
Figure 3:
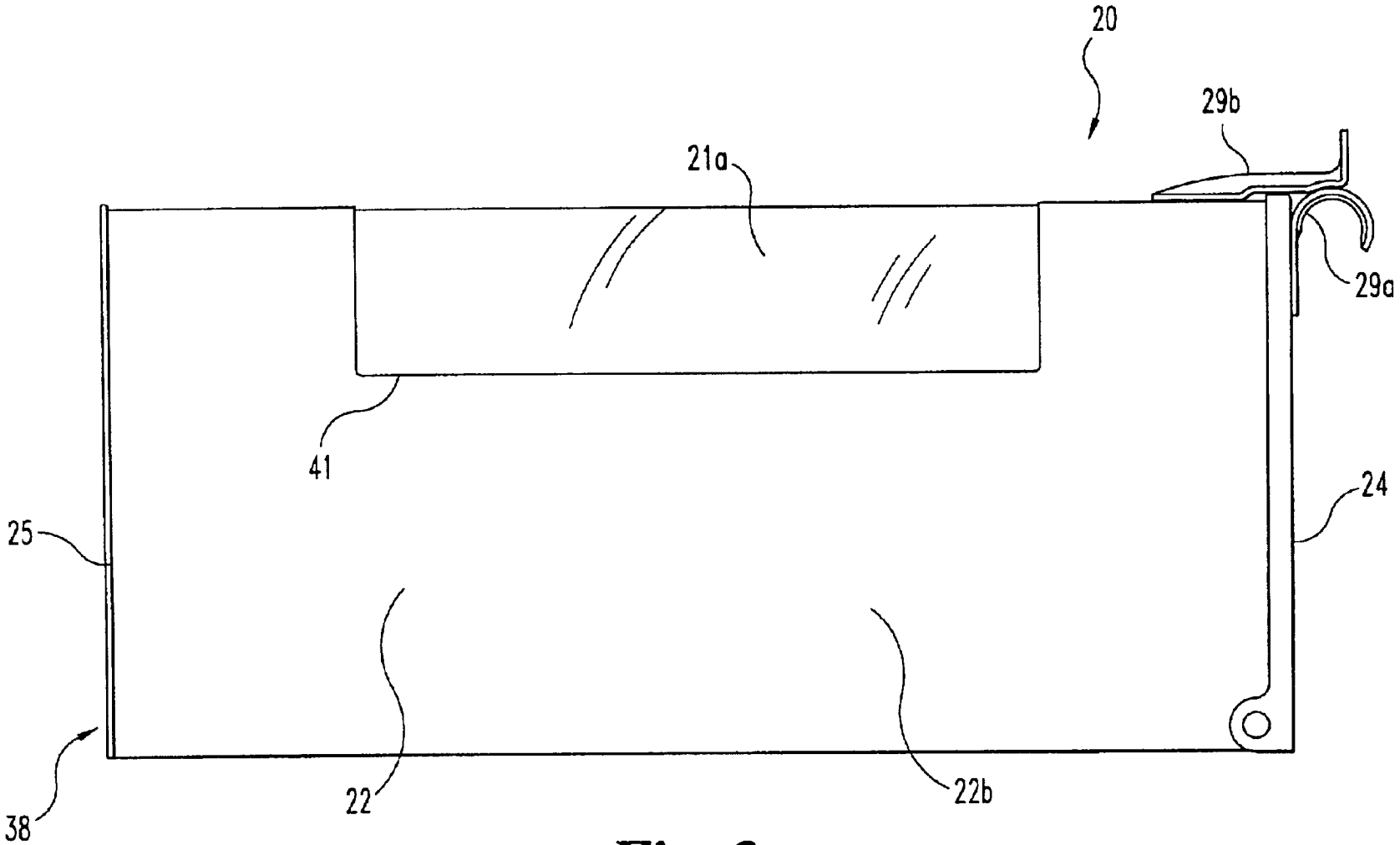
FIG. 3 is a left side elevational view of the FIG. 1 mailbox.

Referring to FIGS. 1–3, there is illustrated a conventional mailbox 20 which has been fitted with transparent panels 21*a* and 21*b*. The mailbox 20 includes a main body 22, a base panel 23, front lid or door 24, and a rear panel 25. The front door 24 has pivot points along its lower, outer corners 26 which function in cooperation with the opposite sides 22*b* and 22*c* of the main body. The front door and sides are pinned or riveted together so as to enable a hinging action to open and close the front door 24. The front door closes against an opening or mouth 27 which is defined by the forward edge 28 of the main body 22 in cooperation with base panel 23. A two-piece catch 29 is designed to enable the door to snap shut and to hold the door 24 closed when positioned up against mouth 27.

While mailbox 20 is intended to represent an approved construction which meets all of the United States Postal Service regulations and specifications, there are design and construction options. Some of these options include the materials used for the mailbox and the specifics of how the various portions are configured and constructed. For example, the base panel 23 and the rear panel 25 may actually be considered part of the main body 22. If molded out of plastic, the main body 22, base panel 23, and rear panel 25 would likely be formed as a unitary member. If the mailbox is fabricated out of metal, these portions, at least in part, may be unitary with other portions and then bent or folded with abutting edges or overlapping portions riveted together.

Figure 4A:
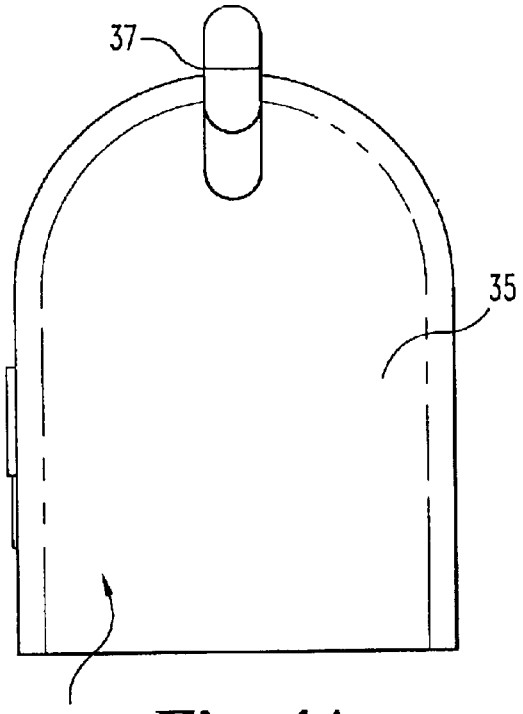
FIG. 4A is a rear elevational view of the FIG. 1 mailbox with a rear door.
Figure 4B:
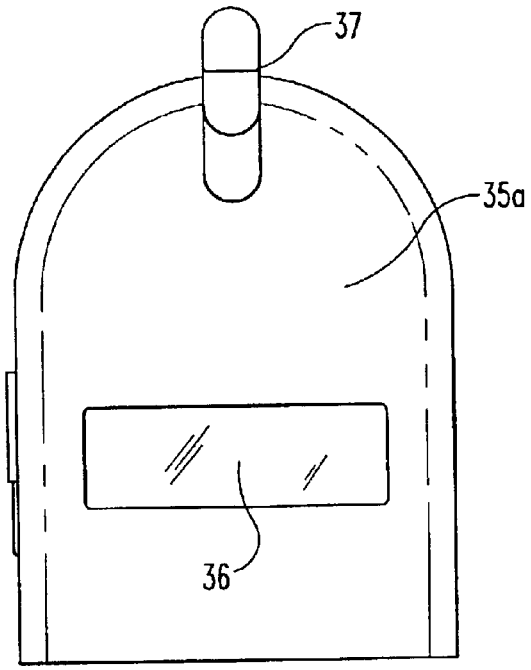
FIG. 4B is a rear elevational view of the FIG. 1 mailbox showing a first variation to the rear door with a transparent panel.

Catch 29 includes two cooperating portions. Portion 29*a* is attached to the front door 24 and portion 29*b* is attached to the main body 22. Mounted to the right side of the main body 22 is a flag 33 which is pinned to the main body and pivots to an upright orientation while seated in holder 34. Catch 29 and flag 33 are of conventional construction and arrangement for mailboxes of this general style. The rear panel 25 may include a transparent panel similar in size, shape and location to transparent panel 21*b* in front door 24. Alternatively, the rear panel 25 may be configured as a rear door 35 (see FIGS. 4A and 4B). In the FIG. 4A embodiment, the rear door 35 is solid. In the FIG. 4B embodiment, the rear door 35*a* is fitted with a transparent panel 36 which is preferably configured so as to be virtually identical to transparent panel 21*b*. Alternatively, these panels 21*b* and 36 could take on a variety of forms, patterns, and positions.

If the mailbox is configured with a rear door 35, it is pinned to the main body 22 in a manner substantially the same as front door 24. In this configuration, the interior of the mailbox, defined by the main body and the base panel, can be accessed from the front or from the rear in substantially the same way. A second catch 37 is used to snap the rear door 35 closed over the rear opening or mouth 38 in this alternate embodiment of mailbox 20.

In the preferred embodiment of FIGS. 1–3, mailbox 20 is approximately 6.5 inches in width across the base panel 23, approximately 19 inches in length, and approximately 8.5 inches in height. The upper portion 22*a* of main body 22 is curved symmetrically from the left side 22*b* to the right side 22*c*. The transparent panel 21*a* is generally rectangular in initial form and flexed into a curved form to fit into the main body 22. Transparent panel 21*a* measures approximately 11 inches in length by 8.25 inches in width and is positioned in main body 22 so as to be approximately centered between front edge 22*d* and rear edge 22*e*. Front edge 22*d* in cooperation with base panel 23 defines mouth 27. Rear edge 22*e* in cooperation with base panel 23 defines mouth 38. Transparent panel 21*a* is also centered between the left side 22*b* and the right side 22*c* of the main body portion. As the size of the mailbox changes, the dimensions of transparent panel 21*a* change so as to maintain the same relative size relationship. The lowermost left edge 41 of transparent panel 21*a* is generally coincident with the line at which the curved upper portion 22*a* ends and the left side 22*b* begins. In a symmetrical manner, the lowermost right edge 42 of transparent panel 21*a* is generally coincident with the line at which the curved upper portion 22*a* ends and the right side 22*c* begins. The preferred material for each of the transparent panels 21*a*, 21*b*, and 36 is LEXAN®. The preferred thickness is a function of the mailbox material thickness, the desired strength, and the selected method of mounting, attaching, inserting, or otherwise affixing each transparent panel into or onto the mailbox. It is also to be noted that each panel 21*a*, 21*b* and 36 may be used singularly or in combination with either or both of the other two transparent panels in configuring mailbox 20 or a related variation or embodiment of mailbox 20. This combination of three transparent panels will actually yield seven (7) possible permutations.

As disclosed herein and as contemplated for the present invention, the various panels which have been described, such as transparent panels 21*a*, 21*b* and 36, are preferably transparent as the selection of LEXAN® as the preferred material would indicate. However, one or more of these transparent panels may be replaced with translucent panels or with color-tinted panels which would allow some light into the mailbox so as to illuminate the contents but which would provide a greater degree of privacy. Translucent and color-tinted panels, which may be offered in a wide variety of styles, still represent a material through which it is possible to see and identify objects or articles which may be on the other side. By the same token, since these panels are not clear, it is more difficult to see through them and thus more difficult for passersby to catch a glimpse of what may be in another person's mailbox. The selection of panels which can be of various colors gives the mailbox owner the option of color coding the mailbox in such a way that the color selected for the panel would match or complement or complete a particular color or design scheme for the corresponding mailbox. While reference is made throughout this disclosed to "transparent panels", it should be understood that in each and every context, one or more of the transparent panels could be replaced by translucent panels and/or color-tinted panels.

With continued reference to FIGS. 1–3, transparent panels 21*b* and 36 are each generally rectangular and measure approximately 4.5 inches in width (i.e. side-to-side length) and approximately 1.5 inches in height. Each of these panels begins as a substantially flat panel and is affixed within or to the front and rear doors, respectively, as substantially flat panels. Since transparent panel 21*a* is placed in the top curved portion 22*a* of the main body 22, the initially flat transparent panel must be flexed in order to conform to the same curved geometry. This particular step though is not required for transparent panels 21*b* and 36 since they begin and end, after installation into the mailbox, as substantially flat panels.

Transparent panel 21*b* is positioned midway between the left and right sides of the front door 24, such that there is an approximately 1 inch border on each side. The transparent panel is positioned relative to a lowermost edge of the front door 24 so as to leave a similar 1 inch border. Transparent panel 36 is positioned in rear door 35 or in the rear panel, depending on how this portion of the mailbox is configured, similar to how transparent panel 21*b* is positioned in the front door 24. As such, there is an approximately 1 inch border on the left and right sides and along the bottom edge between transparent panel 36 and surrounding portion of the rear panel or rear door 35. Even if the rear panel is not configured as a rear door, it may be desirable to include transparent panel 36 simply so that an individual can view into the mailbox from the rear portion as might be desirable in a rural setting where several mailboxes may be aligned side-by-side and where one may not want to walk out into the street to look into the front of the mailbox.

The options for assembly of the transparent panels disclosed as part of this invention into the various styles of mailboxes include cutting a generally rectangular (projected) opening in the main body and/or one or both of the front and rear doors or panels, noting that each opening which is cut needs to be slightly smaller than the corresponding transparent panel to be assembled at that location. The outer peripheral edge of the transparent panel is able to overlap the material of the mailbox surrounding each opening and the transparent panel is able to be attached to the mailbox by applying an epoxy, adhesive, sealant, or caulk around the perimeter of the transparent panel between the overlapping portions of the transparent panel and mailbox. The transparent panel may be attached to the mailbox from the interior of the mailbox or from the exterior of the mailbox.

Another assembly option is to drill aligned through holes through the overlapping layers of the transparent panel and of the mailbox around the peripheral edge of the transparent panel and around the edge of the opening which has been cut, stamped, or punched in the mailbox. Once the aligned through holes are drilled, conventional mounting hardware is used to attach the transparent panel to the mailbox. Such hardware includes threaded fasteners, pins and rivets. A small bead of sealant/adhesive may be used to ensure weather-proofing of the interface between the transparent panel and the mailbox opening.

A still further option is to apply strips of double-sided tape between the overlapping layers of the transparent panel and the mailbox. This option also allows the transparent panel to be assembled from the interior of the mailbox or to be assembled on the exterior of the mailbox.

Figure 18:
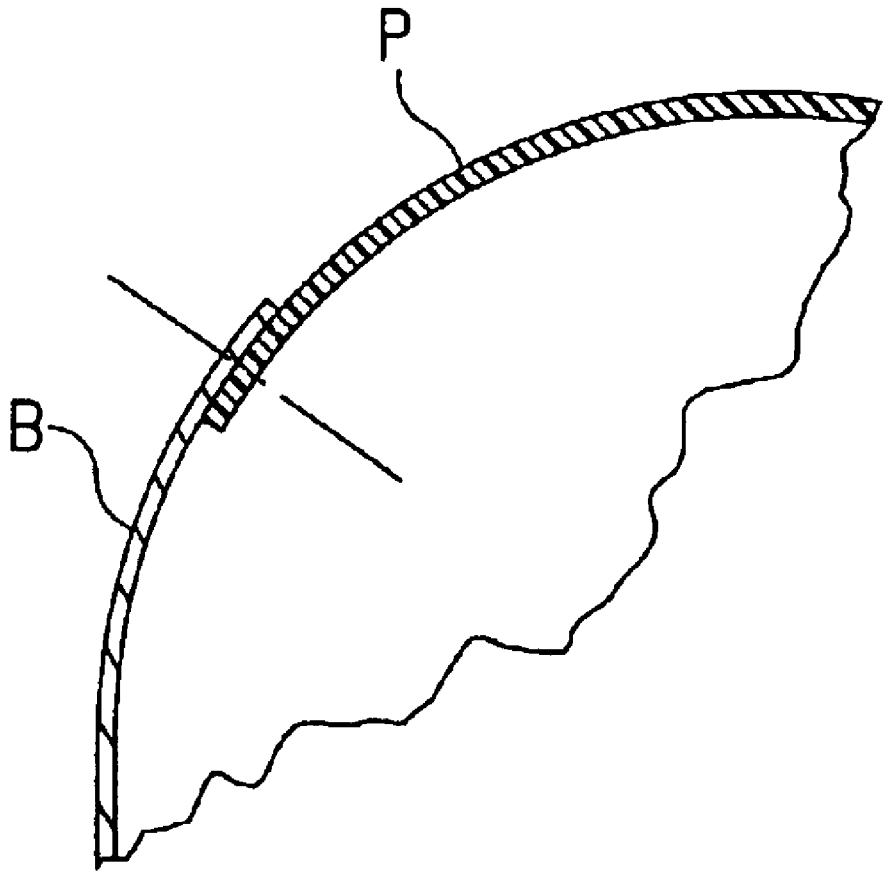
FIG. 18 is a partial, side elevational view in full section of a half lapped transparent panel as assembled into a mailbox according to the present invention.

In all of the foregoing assembly/attachment options described for securing each transparent panel to the mailbox, there will be an exposed lip or edge of the transparent panel, due to the overlapping arrangement. This exposed edge is less noticeable if the transparent panel is installed from the interior of the mailbox. If there is a desire to lessen the exterior visual effect of this exposed, overlapping transparent panel edge, a further option is to half-lap the peripheral edge of the transparent panel. In effect, by milling down half of the thickness of the transparent panel completely around its peripheral edge so as to create a border of approximately ½ inch, it is possible to install the transparent panel from the interior of the mailbox and create an exterior which is flush. This particular half-lapped configuration is illustrated in FIG. 18 by mailbox body (B) and transparent panel (P). Whatever small separation may remain between the outer surface of the transparent panel and the edge of the opening, this may be filled or closed with a sealant/adhesive. The benefit of this design is to have a smooth or flush interfit on the exterior surface and yet retain all of the other mounting options and variations as well as all the options for sealing the transparent panel and mailbox opening interface.

While the mailbox embodiments of FIGS. 1–4B represent some of the preferred design options for adding one or more transparent panels to a mailbox, there are other mailbox embodiments which are contemplated by the present invention, generally consistent with what has been described for the embodiments of FIGS. 1–4B.

Figure 6:
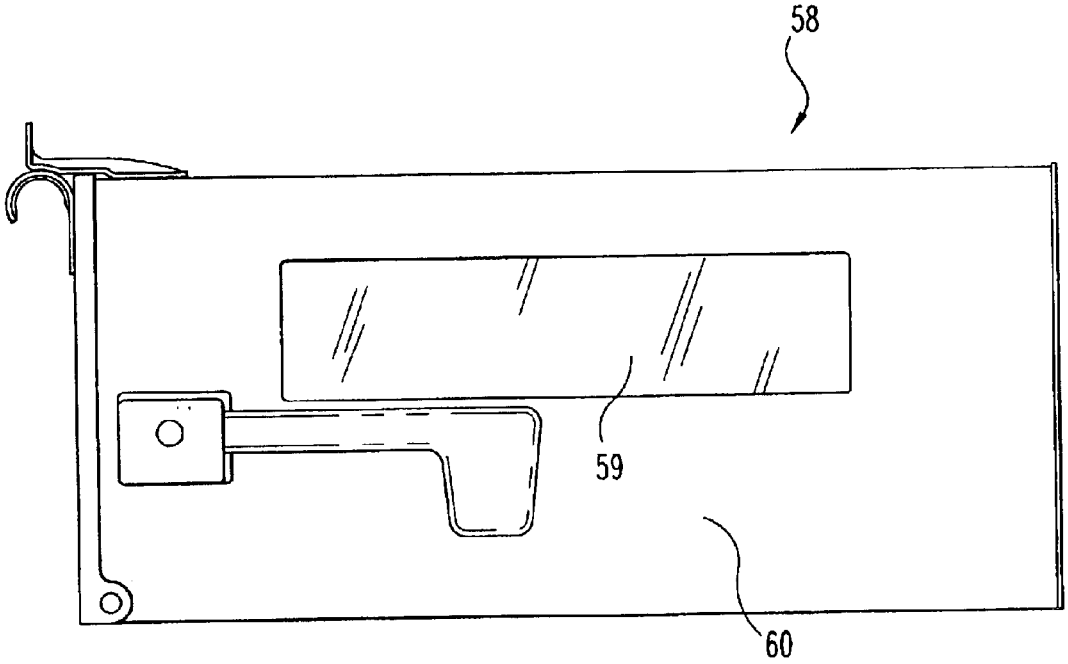
FIG. 6 is a right side elevational view of a mailbox representing another embodiment of the present invention.
Figure 7:
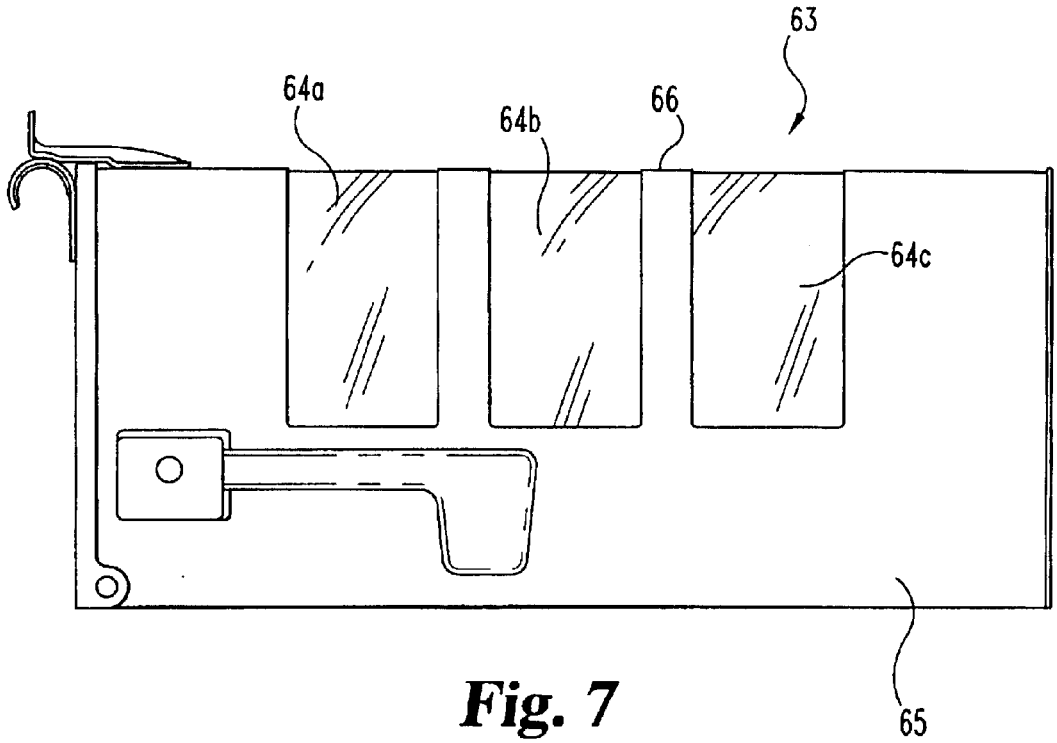
FIG. 7 is a right side elevational view of a mailbox representing another embodiment of the present invention.
Figure 8:
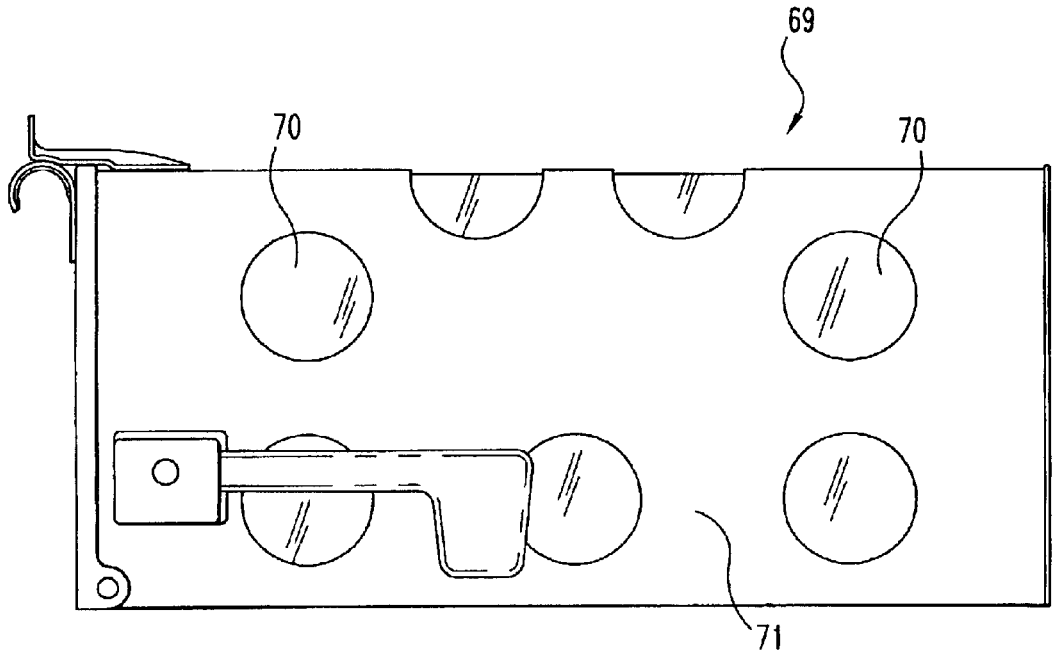
FIG. 8 is a right side elevational view of a mailbox representing another embodiment of the present invention.
Figure 9:
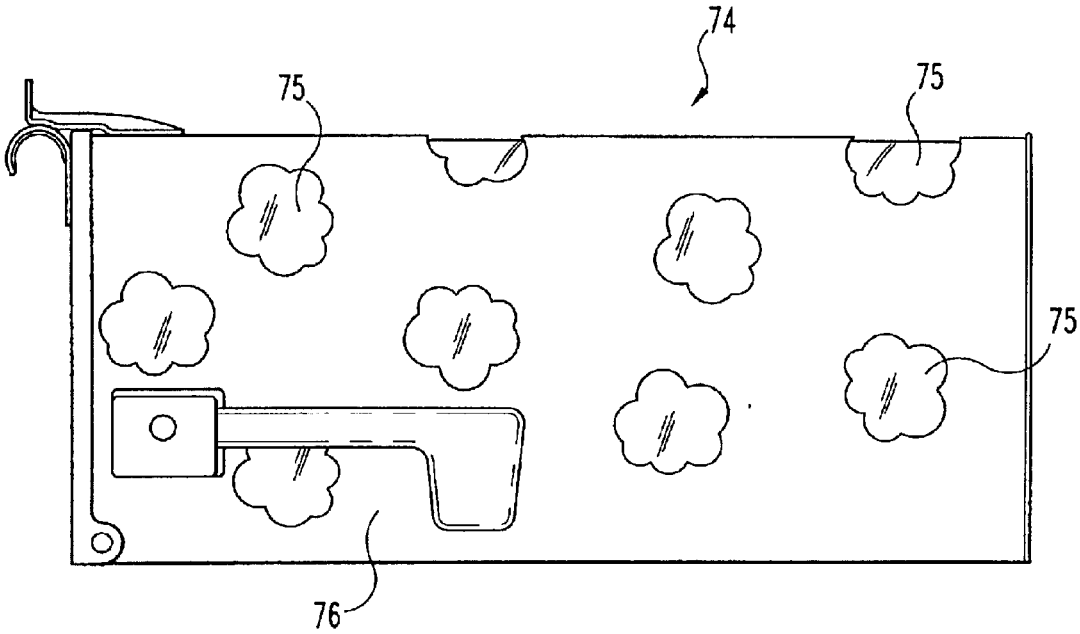
FIG. 9 is a right side elevational view of a mailbox representing another embodiment of the present invention.

With reference to FIGS. 5–16, these other embodiments are illustrated and virtually all of the features, material options, and assembly techniques disclosed relative to the embodiments of FIGS. 1–4B are equally applicable to these other embodiments. In a majority of these other embodiments, the placement of one or more transparent panels into the body and/or doors of the mailbox is accomplished in a symmetrical manner, such that the left side and right side structural configurations or each mailbox embodiment are virtually identical. Accordingly, only the right side of the mailbox is illustrated, noting that the opposite, left side will be virtually identical and symmetrical in all respects. In the embodiments of FIGS. 8 and 9, the individual transparent panels are randomly arranged on the main body of the mailbox. Consequently, even though the referenced pattern is random, it is random throughout the body of the mailbox, including not only the right hand side as illustrated, but also including the upper curved portion and the opposite, left side of the mailbox.

Figure 15:
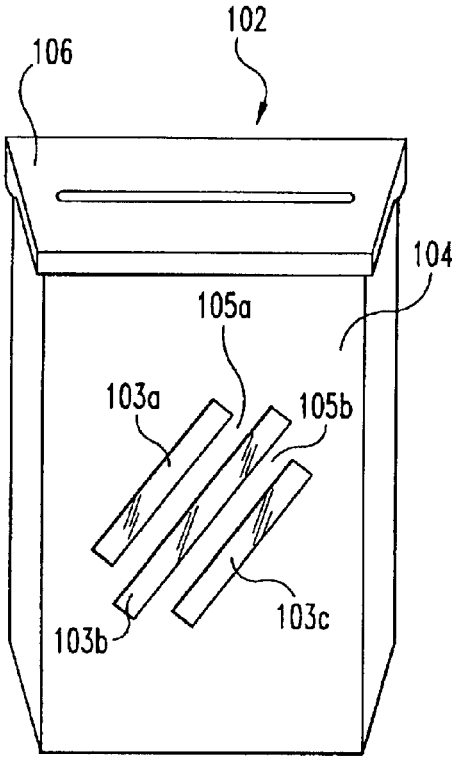
FIG. 15 is a front elevational view of another mailbox with a transparent panel showing a different mailbox shape, according to the present invention.
Figure 16:
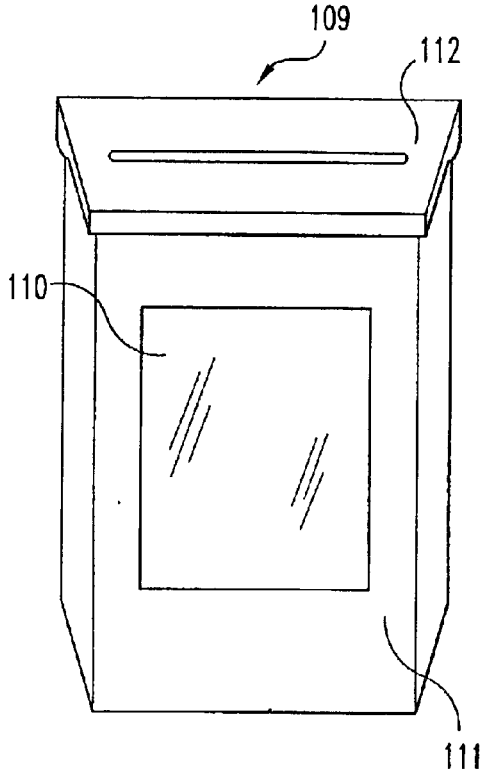
FIG. 16 is a front elevational view of another mailbox with a transparent panel showing a different mailbox shape, according to the present invention.

In the embodiments of FIGS. 15 and 16, wall-mounted mailboxes are disclosed. With these different shapes, as contrasted to what is illustrated for the other embodiments, there is no intent to style the mailboxes with any type of side-to-side symmetry. In these two embodiments, the transparent panels only exist in the front portion of these wall-mounted mailbox styles. However, it is envisioned that a transparent panel can be placed in the hinged lid of each embodiment, either with or without the transparent panel(s) in the front wall portion.

Figure 5:
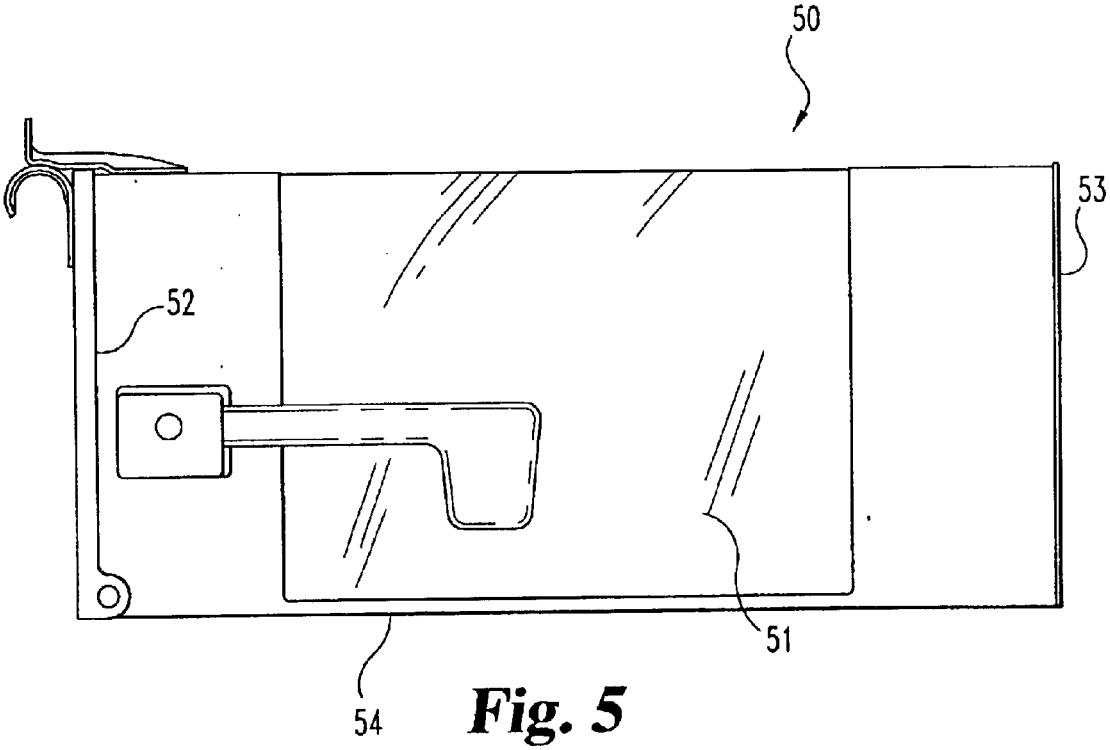
FIG. 5 is a right side elevational view of a mailbox representing another embodiment of the present invention.

Referring now to FIG. 5, mailbox 50 includes a transparent panel 51 which is positioned midway between the front edge 52 and the rear edge 53. Transparent panel 51 extends from the lower edge 54 on the right hand side to the corresponding lower edge on the left hand side.

Referring to FIG. 6, mailbox 58 includes a generally rectangular transparent panel 59 which is symmetrically positioned in right side 60 between the top, bottom, front, and rear of the mailbox. A second, virtually identical transparent panel is symmetrically assembled into the opposite, left side of mailbox 58.

Referring to FIG. 7, mailbox 63 includes a spaced series of three generally rectangular transparent panels 64*a*, 64*b*, and 64*c*. The spacing between each pair of panels is substantially the same as the front-to-rear width dimension. Each transparent panel extends from the right side 65 across the curved top portion 66 of mailbox 63 and down the opposite side panel on the left side such that each transparent panel 64*a*–64*c* is symmetrical between the right side and left side of the mailbox.

Referring to FIG. 8, mailbox 69 includes a randomly arranged plurality of circular transparent panels 70. The diameter size of each circular transparent panel is illustrated as being substantially the same. However, it is contemplated, consistent with the present invention, that the plurality of circular transparent panels 70 can include a plurality of different diameter sizes also randomly arranged across the main body 71 of mailbox 69.

Referring to FIG. 9, mailbox 74 includes a randomly arranged plurality of cluster-shaped transparent panels 75. The specific cluster shapes and sizes are illustrated as being substantially the same. However, it is contemplated, consistent with the present invention, that the plurality of cluster-shaped transparent panels 75 can include a plurality of different cluster shapes and/or a plurality of different sizes, also randomly arranged across the main body 76 of mailbox 74.

While FIGS. 8 and 9 illustrate two mailbox embodiments according to the present invention, these two embodiments are representative of other shapes and sizes of transparent panels which can be configured and randomly arranged on (i.e., assembled to) the main body of each mailbox. For example, the individual transparent panels of the randomly arranged plurality can be diamond-shaped, heart-shaped, or shaped like a design logo or emblem, to mention only a few of the options.

Figure 10:
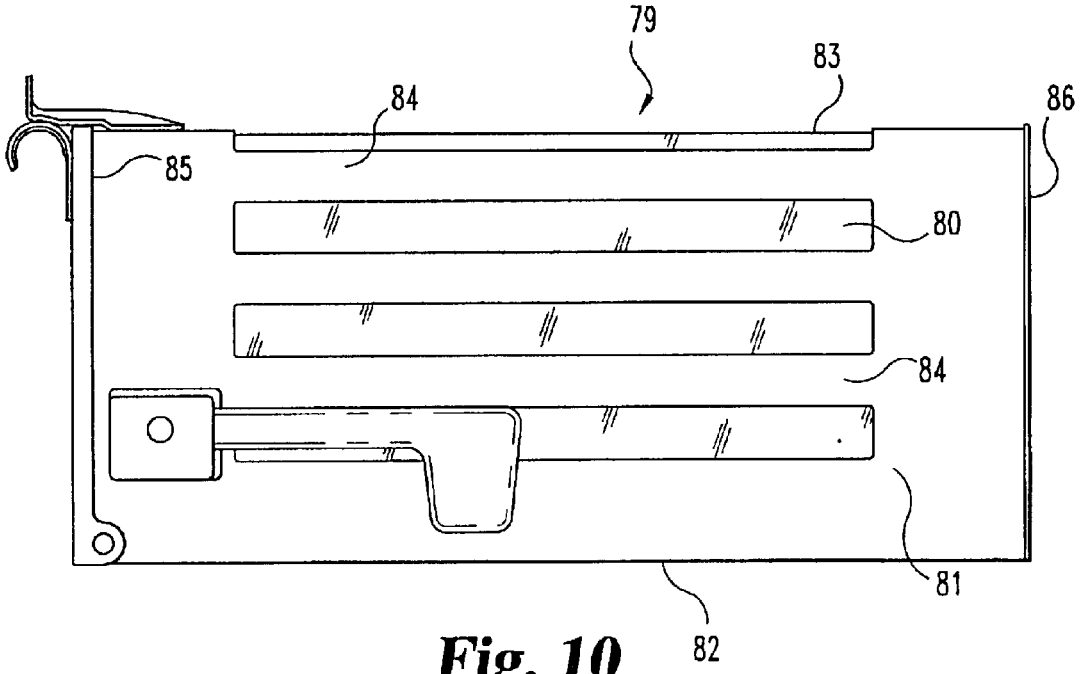
FIG. 10 is a right side elevational view of a mailbox representing another embodiment of the present invention.
Figure 11B:
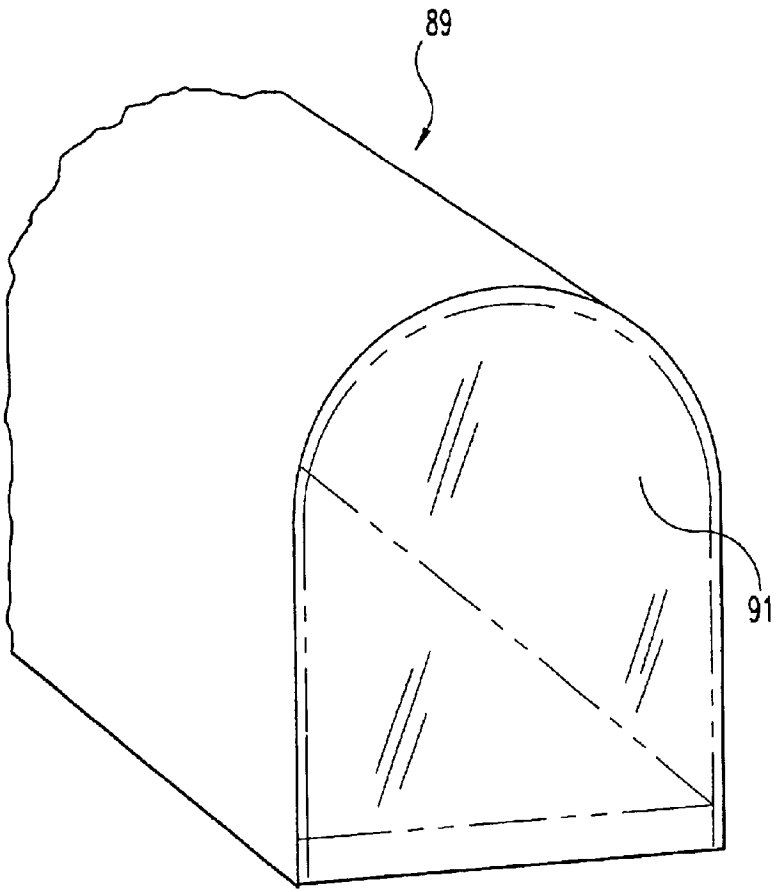
FIG. 11B is a partial, rear perspective view of the FIG. 11A embodiment.
Figure 11A:
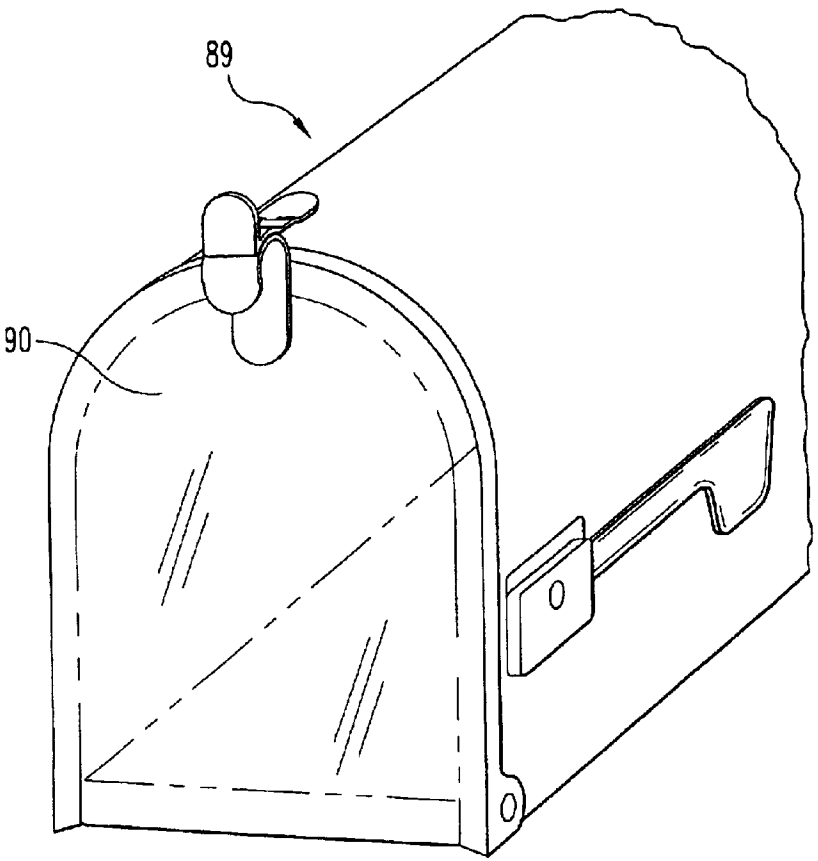
FIG. 11A is a partial, front perspective view of a mailbox representing another embodiment of the present invention.
Figure 12:
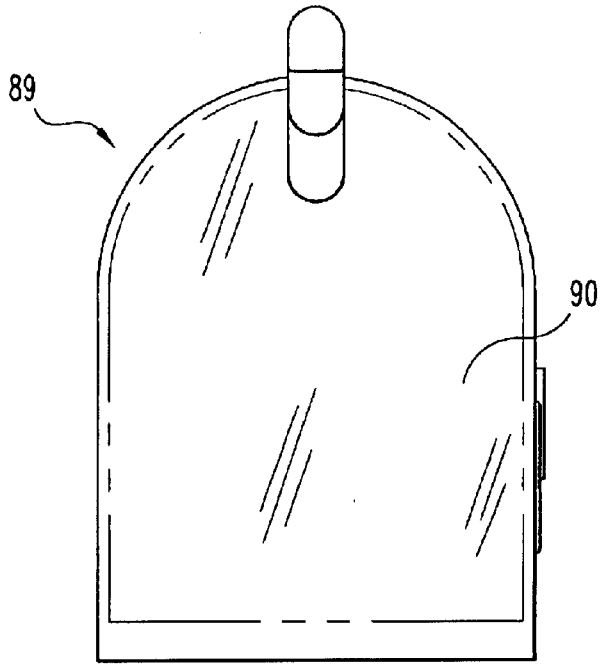
FIG. 12 is a front elevational view of the FIG. 11 mailbox.
Figure 13:
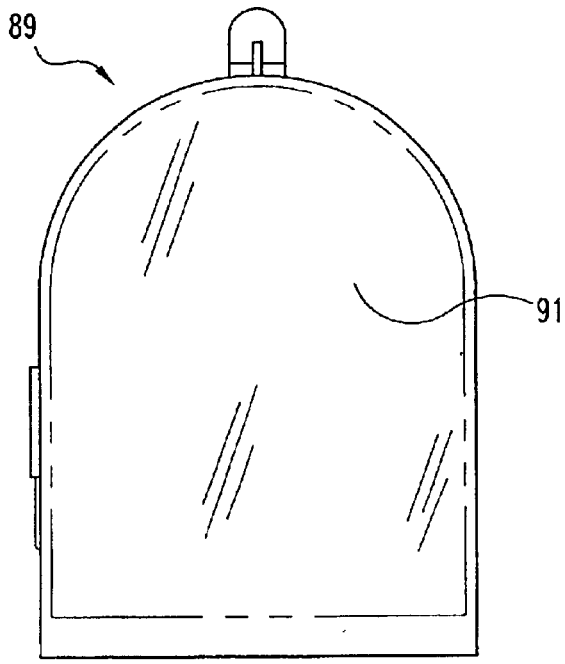
FIG. 13 is a rear elevational view of the FIG. 11 mailbox.

Referring to FIG. 10, mailbox 79 includes a plurality of generally rectangular transparent panels 80 which are assembled to the main body 81 of mailbox 79 in a substantially horizontal pattern. The plurality of transparent panels 80 are equally spaced and extend from a first location adjacent lower edge 82 on the right side, up and over the curved top portion 83 and down the left side to a symmetrical location adjacent the lower edge 82. The width dimension (measured top to bottom) of each transparent panel 80 is substantially equal to the width dimension of the main body portions 84 which are disposed between adjacent transparent panels 80. Each transparent panel is approximately centered between the front edge 85 and the rear edge 86.

Referring to FIGS. 11A, 11B, 12, and 13, mailbox 89 includes a transparent panel 90 configured as the front, hinged door to the mailbox. Additionally, mailbox 89 includes a transparent rear panel 91 configured as part of the main body of mailbox 89. As one variation to the illustrated mailbox 89, the transparent rear panel 91 can be configured as a rear door by adding a hinge and a clasp, as described in the context of FIGS. 1–4B.

Figure 14:
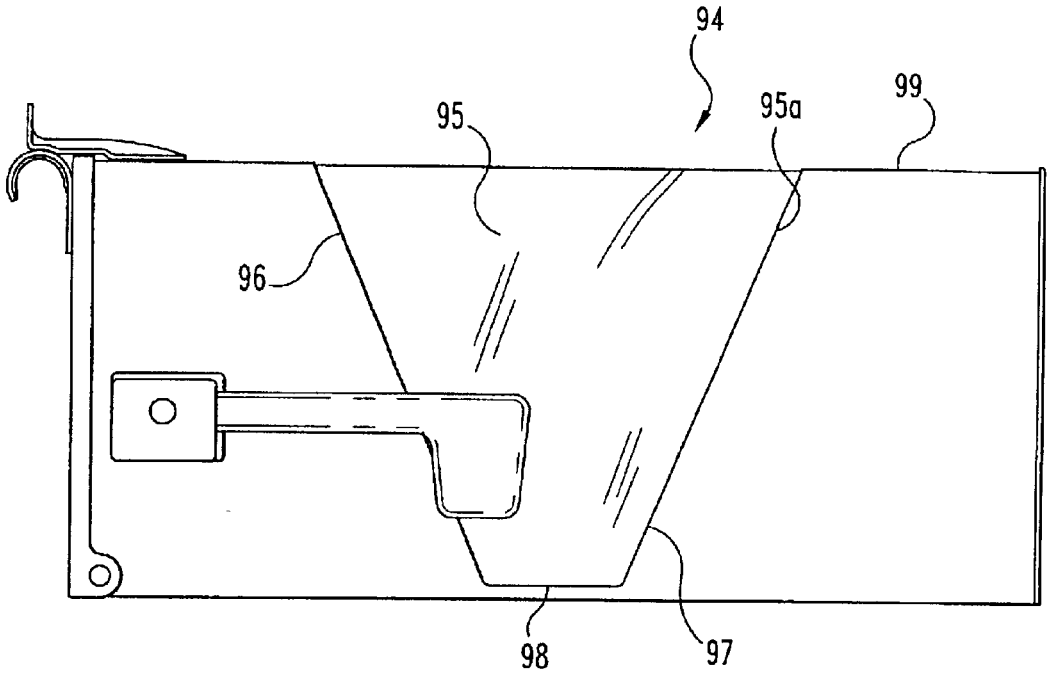
FIG. 14 is a right side elevational view of a mailbox representing another embodiment of the present invention.

Referring to FIG. 14, mailbox 94 includes a single transparent panel 95 which includes a first portion 95*a* on the right side of the mailbox. Portion 95*a* has converging side edges 96 and 97 which taper toward lower edge 98 of mailbox 94. The same transparent panel portion shape exists on the opposite, left side of the mailbox. Edges 96 and 97 extend to the uppermost extent of the curved top portion 99 and then transition symmetrically into the opposite transparent panel portion.

Referring to FIGS. 15 and 16, wall-mounted mailbox styles are illustrated which have been designed and constructed according to the present invention with transparent panels. The FIG. 15 mailbox 102 includes three generally rectangular transparent panels 103*a*, 103*b*, and 103*c* which are spaced apart and arranged in a diagonal orientation on front wall 104 of mailbox 102. The rectangular width of each transparent panel 103*a*–103*c* is virtually identical. The front wall portions 105*a* and 105*b* between adjacent transparent panels have a width dimension (in a direction parallel to the width of each transparent panel) which is substantially the same as the width dimension of the transparent panels. The transparent panels 103*a*–103*c* allow the mail carrier to see what may be in the mailbox before opening hinged lid 106. The arrangement of transparent panels 103*a*–103*c* is generally symmetrical relative to the front wall 104 of the mailbox. With reference to FIG. 16, mailbox 109 includes a generally rectangular transparent panel 110 which has a square shape in the illustrated embodiment and is symmetrically positioned in front wall 111 of mailbox 109. Mailbox 109 is configured as a wall-mounted style with a hinged lid 112.

While it is envisioned that mailboxes according to the present invention will be manufactured in the form illustrated for various embodiments, it is also contemplated that one may wish to modify an existing mailbox, in order to create one of the final structures disclosed herein. For such purpose, a kit is disclosed and is illustrated in FIG. 17.

Figure 17:
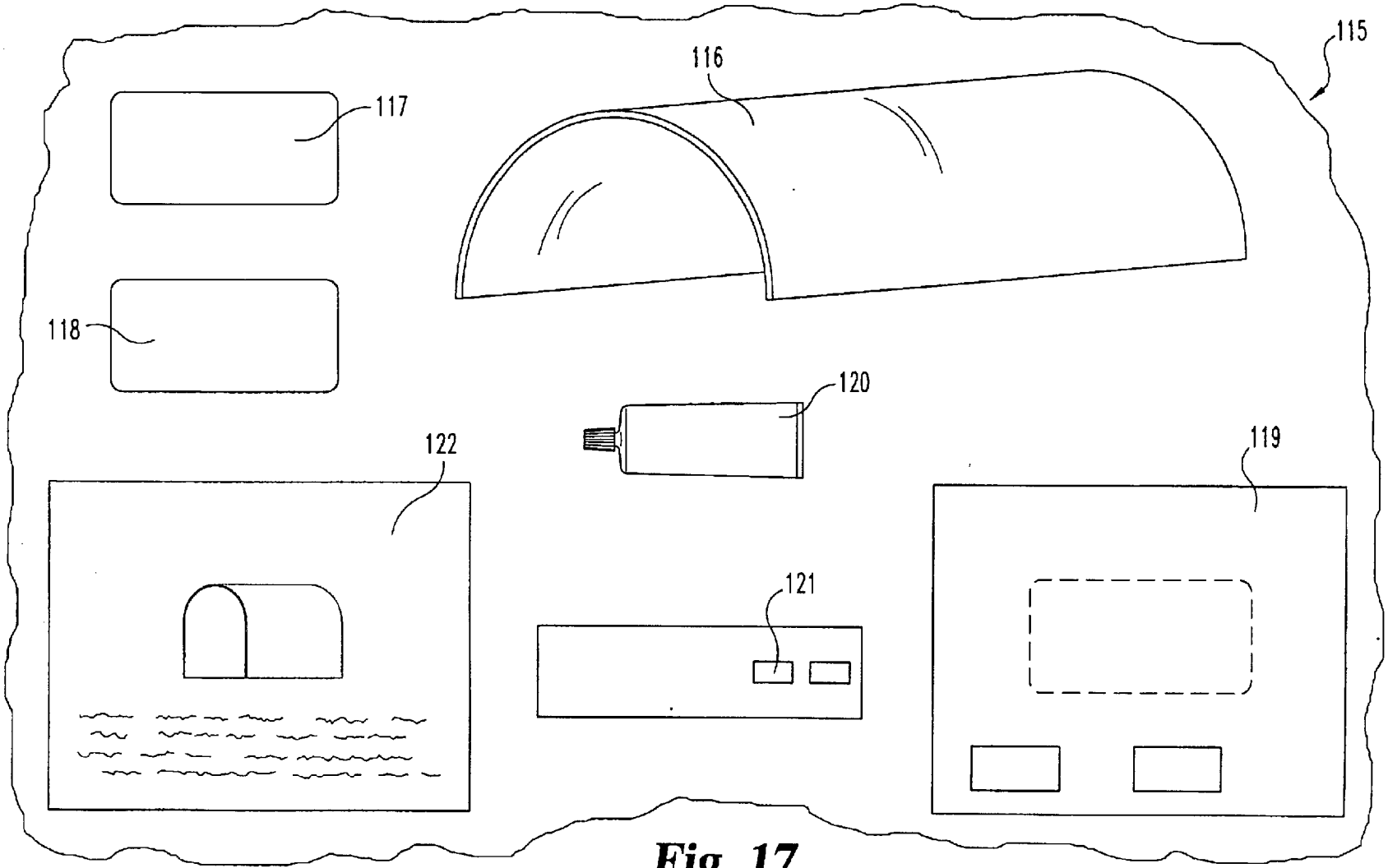
FIG. 17 is a diagrammatic illustration of a kit which may be used for modifying an existing mailbox into one or more of the mailbox configurations according to the present invention.

The FIG. 17 kit 115 includes a larger rectangular panel 116 and two smaller rectangular panels 117 and 118, all three being fabricated out of LEXAN®. A template 119 for tracing the cutting outlines for the mailbox openings and a tube 120 of an adhesive/sealant is also included as part of the kit. The outlines for the panel openings are sized to be slightly smaller than the transparent panels, but otherwise these openings will be to scale so as to correspond to transparent panels 116, 117, and 118. This size difference between the openings which are cut out and the size of the transparent panels provides for the required peripheral edge overlap. In this way, there will be an overlapping location sufficient to apply the adhesive/sealant between the peripheral edge of the panel and the mailbox body. Rubber beads 121 are provided as part of the kit to help hold the transparent panel in place, similar to what is used for the windshield of an automobile. An instruction booklet 122 is also provided as part of kit 115.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A mailbox comprising:

a unitary main body shaped with opposite sides and a curved top portion, said opposite sides in cooperation with said curved top portion defining a front opening, a rear opening, and a base opening, said curved top portion defining a panel opening;

a front door covering said front opening;

a rear panel covering said rear opening;

a base panel covering said base opening;

a curved transparent panel positioned over said panel opening and attached directly to said curved top portion between said front door and said rear panel and wherein said transparent panel in said curved top portion extends down each side of said main body ending on each side at a location which is adjacent said base panel.

2. The mailbox of claim 1 wherein the transparent panel in said curved top portion is substantially rectangular.

* * * * *